US006598499B1

(12) United States Patent
Ernst

(10) Patent No.: US 6,598,499 B1
(45) Date of Patent: Jul. 29, 2003

(54) UNIVERSAL SETTING TOOL FOR ADHESIVELY BONDED REBAR AND THREADED ROD ANCHORS

(75) Inventor: Richard J. Ernst, San Diego, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/238,178

(22) Filed: Sep. 10, 2002

(51) Int. Cl.[7] ..... B25B 13/50

(52) U.S. Cl. ..... 81/53.2; 81/57.33; 81/64; 81/120

(58) Field of Search ..... 81/53.2, 57.33, 81/64, 120

(56) References Cited

U.S. PATENT DOCUMENTS

| | | | | |
|---|---|---|---|---|
| 958,980 | A | | 5/1910 | Thomas |
| 1,549,041 | A | | 8/1925 | Berg |
| 1,566,691 | A | | 12/1925 | Perry |
| 2,326,317 | A | | 8/1943 | Amtsberg |
| 2,336,157 | A | | 12/1943 | Bayes |
| 2,622,466 | A | | 12/1952 | Vanden Bos et al. |
| 2,800,820 | A | | 7/1957 | Retterath |
| 2,933,960 | A | | 4/1960 | Tann et al. |
| 3,244,055 | A | | 4/1966 | Schuermann et al. |
| 3,280,666 | A | | 10/1966 | Neuschotz |
| 3,292,463 | A | | 12/1966 | McKean |
| 3,368,430 | A | | 2/1968 | Levering |
| 3,850,055 | A | * | 11/1974 | Triplett ..... 81/476 |
| 4,404,875 | A | | 9/1983 | Sadanandan et al. |
| 4,513,643 | A | | 4/1985 | McKean |
| 4,536,115 | A | * | 8/1985 | Helderman ..... 411/17 |
| 4,652,193 | A | | 3/1987 | Hibbs |
| 4,872,298 | A | | 10/1989 | Klemic, Jr. |
| 4,982,625 | A | * | 1/1991 | Bonner ..... 81/53.2 |
| 5,492,039 | A | * | 2/1996 | Haikal et al. ..... 81/53.2 |
| 5,681,135 | A | * | 10/1997 | Simonson ..... 411/5 |
| 6,029,417 | A | | 2/2000 | Leibhard et al. |
| 6,050,157 | A | * | 4/2000 | Ludwig et al. ..... 81/121.1 |
| 6,125,726 | A | * | 10/2000 | Vendetti et al. ..... 81/447 |
| 6,416,256 | B1 | | 7/2002 | Surjan et al. |
| 6,470,557 | B2 | * | 10/2002 | Newton et al. ..... 29/456 |

* cited by examiner

*Primary Examiner*—Lee D. Wilson
*Assistant Examiner*—Alvin J. Grant
(74) *Attorney, Agent, or Firm*—Schwartz & Weinrieb

(57) ABSTRACT

A universal setting tool comprises a collet housing for mounting within a chuck mechanism of a rotary drive tool. An axially oriented bore extends into the interior of the collet housing, and a radially expansible and contractible coil spring is disposed within the bore. After the free end portion of an anchor member has been inserted into the spring member, the rotary drive tool, and therefore the collet housing member, is rotated in the clockwise direction so as to effectively cause radial contraction of the spring member such that the spring member tightly engages the anchor member. Rotation of the rotary drive tool in the opposite direction releases the grip of the spring member upon the anchor member. The spring member can engage different anchors having different diametrical extents.

18 Claims, 4 Drawing Sheets

UNIVERSAL SETTING TOOL FOR ADHESIVELY BONDED REBAR AND THREADED ROD ANCHORS

FIELD OF THE INVENTION

The present invention relates generally to tools, and more particularly to a new and improved universal setting tool which is especially adapted for use in connection with the insertion and fixation of different diameter rebars and threaded rods within, for example, blind bores formed within concrete, masonry, rock, and similar substrates or underlying substructures, wherein a suitable adhesive or other similar bonding material is disposed within the blind bores for fixedly securing the rebars and threaded rods therewithin when the adhesive bonding material cures and sets.

BACKGROUND OF THE INVENTION

Rebars and threaded rods, studs, or anchors are extensively utilized within, for example, the construction industry in order to mount various components upon concrete, masonry, rock, and similar substrates or underlying foundations. Normally, the substrate or underlying foundation is provided with a blind bore within which the rebar or threaded rod, stud, or anchor is to be fixedly secured by means of, for example, a suitable adhesive bonding material, which has been previously disposed within the bottom portion of the blind bore or hole, upon curing and setting of the adhesive material. Exemplary threaded stud or anchor systems are disclosed within U.S. Pat. No. 4,982,625 which issued to Bonner on Jan. 8, 1991, and U.S. Pat. No. 4,404,875 which issued to Sadanandan et al. on Sep. 20, 1983. As disclosed within FIG. 1, which substantially corresponds to FIG. 1 of the Sadanandan et al. patent, a blind bore 10 has been drilled within a concrete, masonry, rock, or similar foundation 14, and in order to fixedly secure a threaded stud 5 within the drilled bore 10, a capsule or ampule 8 containing adhesive resin materials is disposed within the bottom of the bore or hole 10. A drive unit 1 comprises an upper end portion 3 which is adapted to be mounted within a chuck mechanism 12 of a rotary drill, not shown, and a lower end portion 4 which is externally threaded in a manner similar to that of the threaded stud 5. An internally threaded nut member 6 is adapted to join the lower externally threaded end portion 4 of the drive unit 1 to the upper end portion of the threaded stud 5 as a result of the convexly shaped end portion 11 of the drive unit 1 being disposed in abutment with the upper planar end portion of the threaded stud 5.

When the threaded stud 5 is to be fixedly secured within the bore or hole 10 of the foundation or substrate 14, the lower chamfered or tapered end portion 7 of the threaded stud 5 is forced downwardly against the capsule or ampule 8 so as to fracture the same, and upon actuation of the drill tool, not shown, the threaded stud 5 is driven downwardly to the bottom end portion of the bore or hole 10 so as to not only be seated within the lowermost depth portion thereof but to also agitate and fully mix the adhesive resin materials or components together. When the threaded stud 5 is fully seated within the lowermost depth region of the bore or hole 10, operation of the drill tool is terminated, and a pair of wrenches are respectively applied to the nut member 6 and the intermediate hexagonally-configured portion 2 of the drive unit 1. Upon rotation of such members 6,2 in the opposite directions, the drive unit 1 is separated from the nut member 6 and the threaded stud 5. When the adhesive bonding materials cure and set, the threaded stud 5 is fixedly secured within the foundation 14 so as to permit various components or devices to be mounted thereon or attached thereto. While the aforenoted patented system or assembly is operatively viable, it is apparent that in order to release the,drive unit 1 from the threaded stud 5 which is mounted within the foundation 14, the disengagement operation or procedure is relatively time-consuming due to the need for utilizing a pair of wrenches, and in addition, in light of the fact that a pair of wrenches are required to be used, additional tools need to be carried or utilized by the operator personnel.

Accordingly, the threaded stud or anchor system, as disclosed within the aforenoted patent to Bonner, was developed so as to effectively overcome the various operational disadvantages or drawbacks characteristic of the anchor system disclosed within the aforenoted patent to Sadanandan et al., and as disclosed within FIG. 2, which corresponds substantially to FIG. 1 of the Bonner patent, a drilled hole 11 is formed within a concrete foundation member 10, and a breakable capsule 12, containing a suitable chemical adhesive material, is disposed within the bottom of the bore 11. An externally threaded stud or anchor 13 is adapted have its conically shaped or pointed lower end portion 14 inserted within the drilled bore 11, while the upper end portion of the threaded stud or anchor 13 is adapted to be disposed within a driver 18. The lower end portion of the driver 18 is provided with an internally threaded bore 26, and the axially inner end portion of the bore or hole 26 is undercut or radially enlarged as at 27, while the transversely extending end wall of the bore or hole 26 has an axially tapered face 28.

An adaptor 30 is releasably attached to the upper end portion of the driver 18 by means of a transversely oriented retainer pin 38 and is provided for operatively connecting the driver 18 to a rotary drive means, such as, for example, an electric drill, not shown. The adaptor 30 comprises an upper shank portion 31 which is adapted to be disposed within the chuck portion of the drill, and a lower shaft portion 34 which is adapted to be seated within an axial bore 35 formed within the upper body portion 19 of the driver 18. The transversely extending pin 38 extends through a transverse bore 40 formed within the upper body portion 19 of the driver 18, as well as through a transverse bore 39 formed within the adaptor shaft portion 34, and is retained in position by means of an O-ring 41 disposed within a peripheral groove 42. It is noted that when the upper end portion of the threaded stud or anchor 13 is disposed within the internally threaded bore or hole portion 26 of the driver 18, the axially tapered face 28 comprising the transversely extending end wall of the bore or hole 26 will be disposed in pressed contact with the convexly shaped upper end portion 15 of the threaded stud or anchor 13. It is further noted that the mode of operation of drivingly inserting the threaded stud or anchor 13 within the bore 11 of the foundation 10 is submitted to be readily apparent, and is similar to that previously described in connection with the aforenoted patent to Sadanandan et al., and therefore, a detailed description of the same will be omitted. In addition to the use of suitable chemical adhesive materials, within such anchor bonding systems such as those disclosed within the aforenoted Sadanandan et al. and Bonner patents, wherein the chemical adhesive materials are initially disposed within self-contained capsules or ampules which are adapted to be subsequently fractured by means of the lower end portions of the threaded rods or anchors, it is noted that other types of adhesive components may also be used within such anchoring systems, such as, for example, the rope, slug, or stick as disclosed within U.S. Pat. No. 6,416,256 which issued to Surjan et al. on Jul 9, 2002.

While the aforenoted threaded anchor insertion systems of Bonner and Sadanandan et al. have proven to be commercially successful, it can nevertheless be readily appreciated that the systems of Bonner and Sadanandan et al. are only capable of being used to drivingly insert threaded rods or anchors into the pre-drilled bores or holes within the underlying substrates or foundations in view of the fact that threaded engagement must be defined between the upper free end portion of the threaded rod or anchor and the driver or drive unit. Accordingly, such drive insertion systems cannot be used in connection with the insertion and fixation of rebar members within bores or holes pre-drilled within underlying substrates or foundations, and similarly, such drive insertion systems cannot be used in connection with the insertion of rebars, or threaded rods or anchors, which have different diametrical extents.

A need therefore exists in the art for a new and improved setting tool or drive mechanism, for use in connection with rebars, or threaded rods or anchors, and the like, which are adapted to be fixedly secured within concrete, masonry, rock, or similar foundations or underlying substrates by means of suitable adhesive materials disposed within pre-drilled bores or holes, wherein the same setting tool or drive mechanism can be utilized in conjunction with the insertion and fixation of both rebar or threaded rod type anchors, wherein further, the same setting tool or drive mechanism can be utilized in conjunction with the insertion and fixation of different rebar or threaded rod type anchors having different diametrical extents, and wherein the setting tool or drive mechanism can quickly engage both the rebar or threaded rod type anchor so as to impart the necessary rotary motion thereto in order to effectively insert the same into the adhesive material as well as to cause mixing and activation of the adhesive material, as well as rapidly disengage the rebar or threaded rod type anchor so as not to disturb the same while the adhesive material is curing and setting.

OBJECTS OF THE INVENTION

Accordingly, it is an object of the present invention to provide a new and improved setting tool which is effectively universal in that the same can be used in connection with the insertion and fixation of both threaded rod and rebar type anchors within bores or holes which are pre-drilled within underlying substrates or foundations and which have suitable adhesive bonding materials disposed therein.

Another object of the present invention is to provide a new and improved setting tool which is effectively universal in that the same can be used in connection with the insertion and fixation of both threaded rod and rebar type anchors within bores or holes which are pre-drilled within underlying substrates or foundations and which have suitable adhesive bonding materials disposed therein, whereby such new and improved setting tool effectively overcomes the various operational disadvantages or drawbacks characteristic of PRIOR ART setting tools.

An additional object of the present invention is to provide a new and improved setting tool which is effectively universal in that the same can be used in connection with the insertion and fixation of both threaded rod and rebar type anchors within bores or holes which are pre-drilled within underlying substrates or foundations and which have suitable adhesive bonding materials disposed therein, and wherein further, the setting tool can also be used in connection with the insertion and fixation of different rebar and threaded rod type anchors having different diametrical extents.

A further object of the present invention is to provide a new and improved setting tool which is effectively universal in that the same can be used in connection with the insertion and fixation of both threaded rod and rebar type anchors within bores or holes which are pre-drilled within underlying substrates or foundations and which have suitable adhesive bonding materials disposed therein, and wherein further the setting tool can rapidly engage both the threaded rod and rebar type anchors so as to readily and quickly perform the insertion and fixation procedures.

A last object of the present invention is to provide a new and improved setting tool which is effectively universal in that the same can be used in connection with the insertion and fixation of both threaded rod and rebar type anchors within bores or holes which are pre-drilled within underlying substrates or foundations and which have suitable adhesive bonding materials disposed therein, and wherein further the setting tool can be rapidly disengaged from both the threaded rod and rebar type anchors so as to readily and quickly complete the insertion and fixation procedures without adversely affecting or disturbing the disposition of the threaded rod or rebar type anchors within the adhesive bonding material disposed within the pre-drilled bores or holes defined within the underlying substrate or foundation.

SUMMARY OF THE INVENTION

The foregoing and other objectives are achieved in accordance with the teachings and principles of the present invention through the provision of a new and improved setting tool which comprises a collet member which comprises a stub shaft portion at one end thereof for fixed disposition within a rotary chuck mechanism of a rotary drive tool, and an axially oriented stepped bore extends into the interior of the collet from the opposite-end thereof. A coil spring is disposed within the stepped bore, and one end of the coil spring is staked or secured upon the collet. The coil spring effectively defines an axially oriented expansible and contractible tubular member into which a free end portion of a rebar or threaded rod anchor member can be inserted. In this manner, after the free end portion of the rebar or threaded rod anchor member has been inserted into the tubular spring member, the rotary drive tool, and therefore the collet member through means of its stub shaft fixedly mounted within the rotary tool chuck mechanism, is rotated in the clockwise direction so as to effectively cause a radial contraction of the tubular spring member. Continued rotation of the collet member eventually causes sufficient radial contraction of the tubular spring member such that the tubular spring member will tightly engage the rebar or threaded rod anchor member so as to effectively establish a drive connection with the rebar or threaded rod anchor member.

Accordingly, when the opposite end of the rebar or threaded rod anchor member is then inserted into an adhesive material, which is disposed within a pre-drilled bore or hole formed within an underlying substrate or foundation, further rotation of the chuck mechanism and the collet member will correspondingly cause rotation of the threaded rod or rebar anchor member, as a result of the aforenoted drive connection defined between the radially contracted tubular spring member and the rebar or threaded rod anchor member, so as to mix and activate the adhesive material.

Upon complete insertion of the rebar or threaded rod anchor member into the adhesive material so as to achieve its finalized disposition within the pre-drilled bore or hole formed within the underlying substrate or foundation, rotation of the rotary drive tool in the opposite counterclockwise direction causes a corresponding rotation of the collet member and the tubular spring member thereby causing the tubular spring to readily undergo radial expansion whereby the tubular spring member is effectively released or disengaged from its driven interconnection with respect to the rebar or threaded rod anchor member so as to permit the setting tool to be quickly removed from the rebar or threaded rod anchor member without adversely affecting or disturbing the same with respect to its adhesively bonded disposition within the pre-drilled bore or hole formed within the underlying substrate or foundation. As a result of the provision of the radially expansible and contractible spring member, both rebar and threaded rod anchor members are able to be drivingly inserted into the adhesive material disposed within the bores or holes pre-drilled within the underlying foundations or substrates, and in addition, different rebars or threaded rod anchor members, having different diametrical extents, can be driven by means of the setting tool of the present invention.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 4:
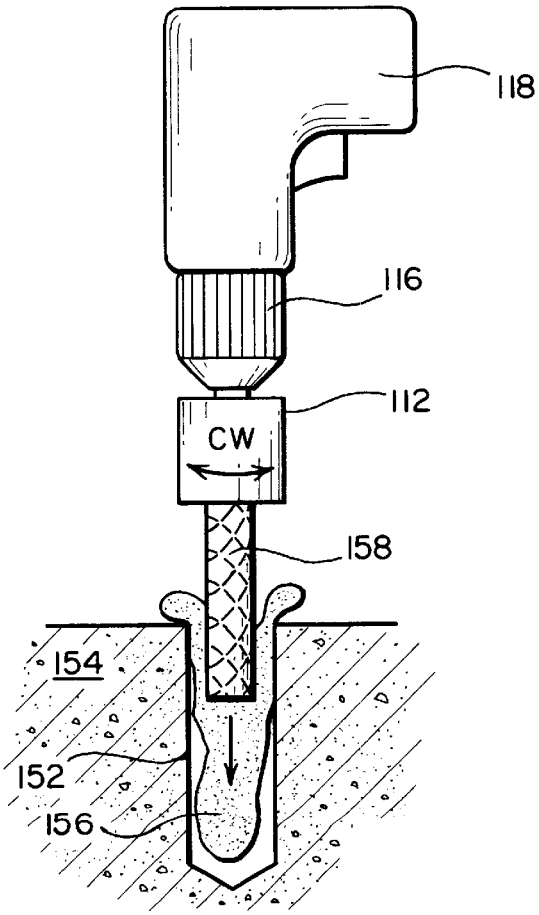
Figure 5:
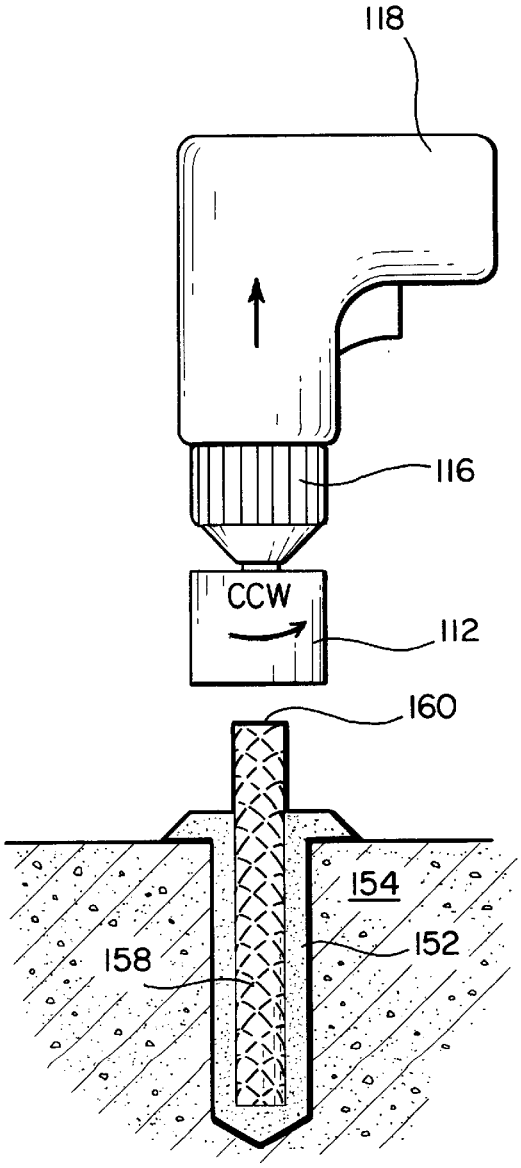
Figure 6:
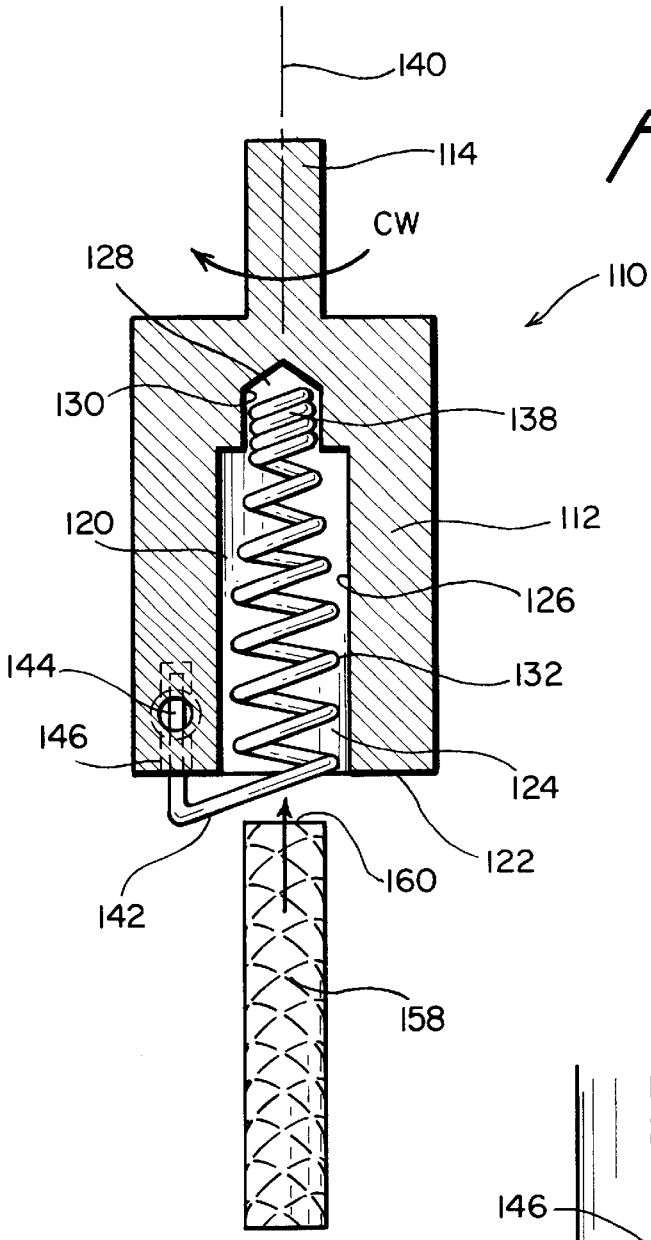
FIG. 6 is a cross-sectional view of the new and improved setting tool constructed in accordance with the principles and teachings of the present invention and showing the details thereof concerning the disposition of the tubular, radially expansible and contractible coil spring member within the collet member.

Referring now to the drawings, and more particularly to FIGS. 3–8 thereof, a new and improved setting tool, constructed in accordance with the teachings and principles of the present invention, is disclosed and is generally indicated by the reference character 110. As best seen in FIG. 6, the setting tool 110 comprises a substantially cylindrical collet housing 112 which has an axially extending stub shaft 114 integrally formed at, for example, upon a first upper end portion thereof, and it is to be appreciated that the stub shaft 114 is adapted to be inserted within a chuck mechanism 116 of a speed-controlled power tool 118, such as, for example, an electric drill. The second opposite lower end portion of the collet housing 112 has a stepped cylindrical bore 120 defined therein, wherein the stepped bore 120 extends axially inwardly from a lower end surface 122 of the collet housing 112. More particularly, the stepped bore 120 is seen to comprise a first large-diameter bore portion 124 as defined by means of a first interior peripheral wall portion 126, and a second small-diameter bore portion or pocket 128 as defined by means of a second interior peripheral wall portion 130, wherein the stepped bore 120 is adapted to house or accommodate a coil spring member 132, the actual specifications or structural characteristics of which are more clearly appreciated from FIG. 7.

Figure 7:
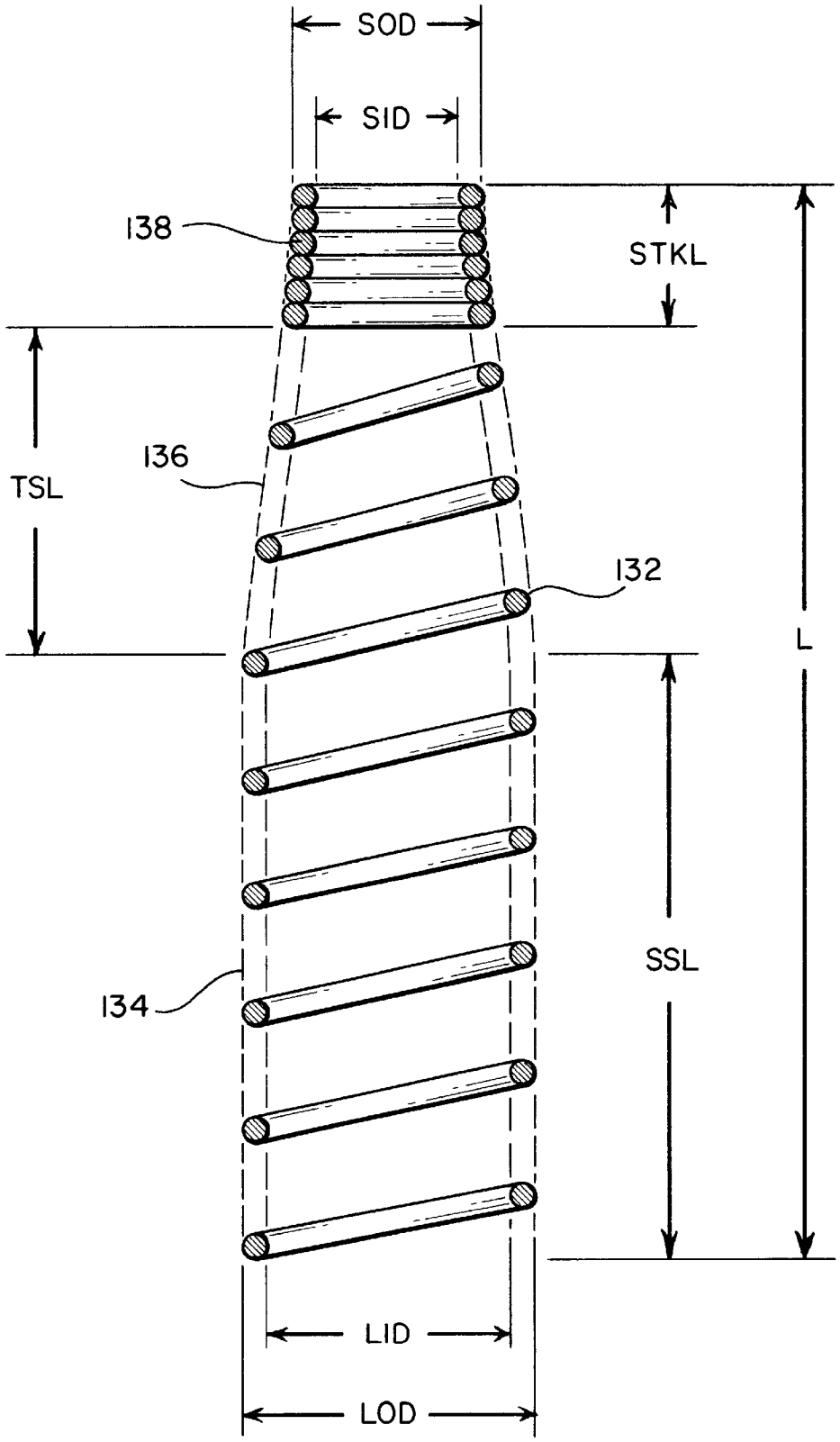
FIG. 7 is an enlarged, cross-sectional view of the tubular, radially expansible and contractible coil spring member component of the new and improved setting tool of the present invention.

More particularly, as can best be appreciated from FIG. 7, the coil spring member 132 preferably has an overall length dimension L of approximately four inches (4.00"), and accordingly, the axial extent or depth of the stepped bore 120 defined within the collet housing 112 has a substantially corresponding dimension so as to properly accommodate the coil spring member 132 therewithin as can best be appreciated from FIG. 6. The coil spring member 132 is seen to comprise a first lower straight, large diameter tubular section 134, a second upper-intermediate tapered diameter section 136, and a third uppermost small diameter section 138 comprising a plurality of axially compressed stacked spring coils. The first lower straight, large diameter tubular section 134 has an axial length dimension (SSL) of approximately two and one-quarter inches (2.25"), an outside diameter (LOD) dimension of approximately 1.055 inches, and an inside diameter (LID) dimension of approximately 0.875 inches, with the wire forming the coil spring member 132 having a thickness dimension or diameter of 0.090 inches. In a similar manner, it is noted that the second upper-intermediate tapered diameter section 136 has an axial length dimension (TSL) of approximately one and one-quarter inches (1.25"), and it is noted that the pitch of the coil spring member 132, as defined between successive coils of the coil spring member 132 throughout both the first lower straight, larger diameter tubular section 134 and the second upper-intermediate tapered diameter section 136, is approximately seven sixteenths of an inch (0.4375") which is sufficiently large so as to permit any burrs present upon the rebar members to effectively self-thread through the coil spring member 132. Lastly, it is noted that the third uppermost small diameter section 138 of the coil spring member 132 comprising the plurality of stacked spring coils has an axial length dimension (STKL) of approximately one-half inch (0.50"), and that the outside diameter (SOD) dimension of such spring section 138 is 0.680 inches while the inside diameter (SID) dimension of such spring section 138 is 0.500 inches.

Figure 8:
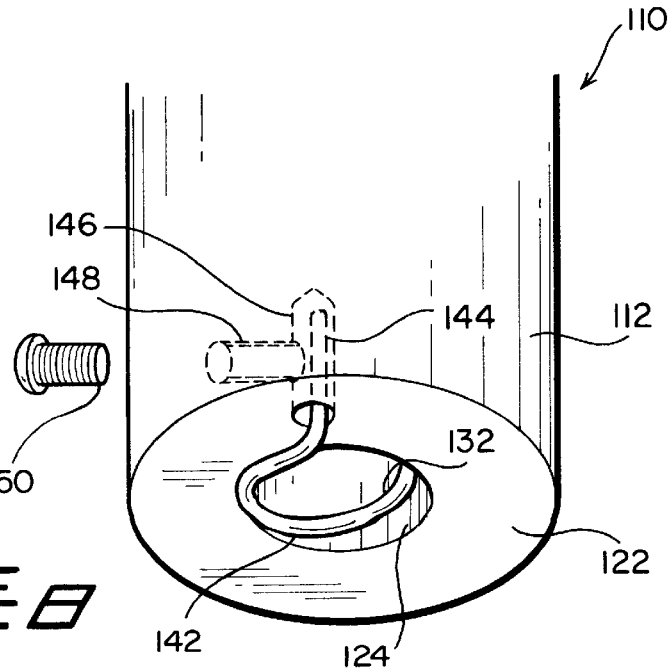
FIG. 8 is a partial perspective view of the collet member of the new and improved setting tool of the present invention showing the details of fixedly staking or securing the free end portion of the tubular, radially expansible and contractible coil spring member component within the collet member.

With particular reference again being made to FIG. 6, as well as FIG. 8, it is seen that when the coil spring member 132 is disposed within the collet housing 112, the uppermost small diameter stacked coil section 138 of the coil spring member 132 is disposed within the small diameter bore portion 128 of the collet housing 112, and in this manner, such relative disposition of the uppermost small diameter stacked coil section 138 of the coil spring member 132 within and with respect to the small diameter bore portion or pocket 128 of the collet housing 112 effectively serves to transversely or radially confine the uppermost small diameter stacked coil section 138 of the coil spring member 132 to a position which is substantially located along and centered upon the longitudinal axis 140 of the collet housing 112. In addition, it is seen that the lowermost end coil 142 of the coil spring member 132 projects outwardly from the stepped bore 120 and extends radially outwardly beyond the outer diametrical extent of the large diameter bore portion 124 so as to terminate at a terminal end portion 144.

In particular, it is further seen that the terminal end portion 144 of the coil spring member 132 is bent upwardly with respect to such lowermost end coil 142 at an angle of approximately 900 so as to be disposed substantially parallel to the longitudinal axis 140 of the collet housing 112. The upwardly bent terminal end portion 144 of the coil spring member 132 may have an axial length of approximately one inch (1.00"), and it is further appreciated that the lowermost end portion of the collet housing 112 is provided with a bore 146 which extends axially inwardly from the lower end surface portion 122 of the collet housing 112 so as to have a corresponding depth of approximately one inch (1.00") for accommodating the terminal end portion 144 of the coil spring member 132. As best seen in FIG. 8, the lower end portion of the collet housing 122 is provided with a bore 148 which extends substantially radially inwardly from an outer peripheral surface portion of the collet housing 112 so as to intersect the axial bore 146. The bore 148 is internally threaded so as to operatively receive a suitable set screw 150 such that when the set screw 150 is fully threadedly engaged within the internally threaded bore 148, the inner terminal end of the set screw 150 will engage the bent terminal end portion 144 of the coil spring member 132 so as to fixedly secure the bent terminal end portion 144 of the coil spring member 132 within the axially extending bore 146. In particular, the set screw 150 not only prevents the bent terminal end portion 144 of the coil spring member 132 from becoming disengaged from the axially extending bore 146 by being axially with-drawn therefrom, but in addition, the set screw 150 also prevents any relative rotation of the bent terminal end portion 144 of the coil spring member 132 with respect to the axially extending bore 146. It is to be noted that while the bore 148 has been illustrated as being radially oriented, the bore 148 may alternatively be oriented in a chordwise manner with respect to axial bore 146.

Figure 1:
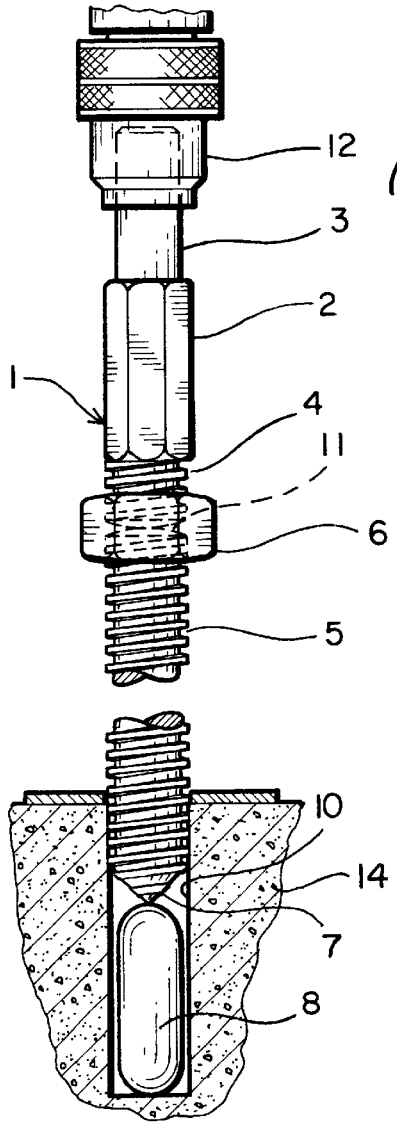
FIG. 1 (PRIOR ART)
FIG. 1 is an elevational view, partly in cross-section, of a first, conventional, PRIOR ART system for driving and setting a threaded rod or anchor within a pre-drilled hole or bore defined within an underlying substrate or foundation.
Figure 2:
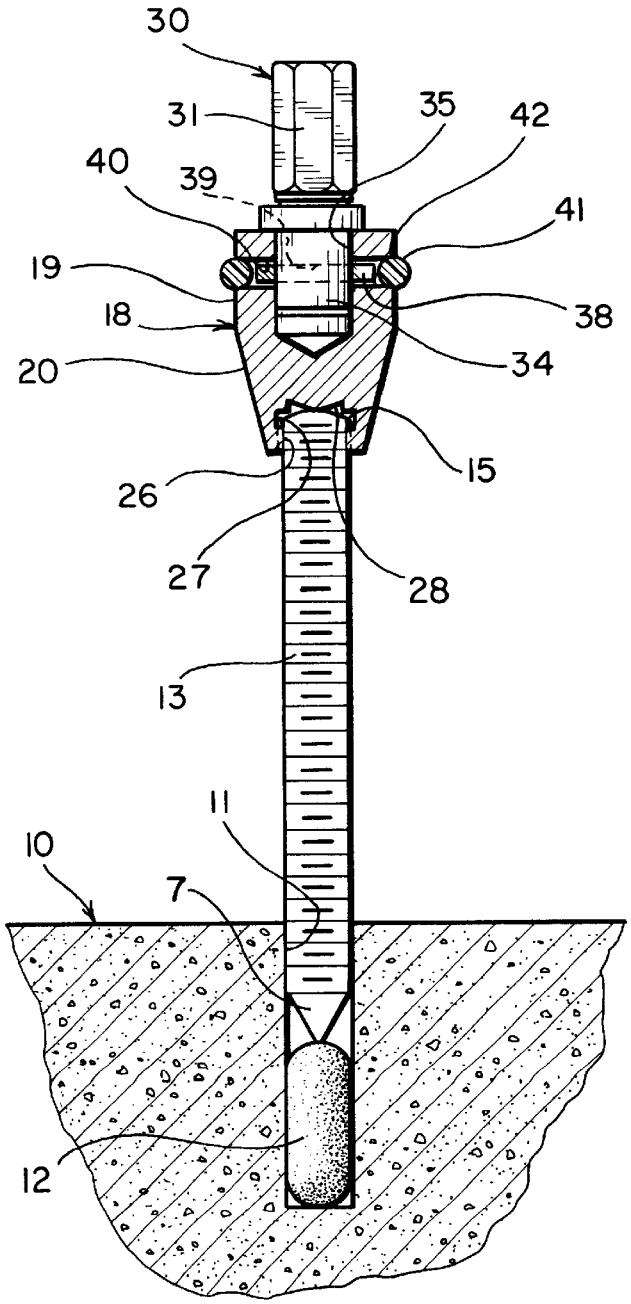
FIG. 2 (PRIOR ART)
FIG. 2 is an elevational view, partly in cross-section, of a second, conventional, PRIOR ART system for driving and setting a threaded rod or anchor within a pre-drilled hole or bore defined within an underlying substrate or foundation.
Figure 3:
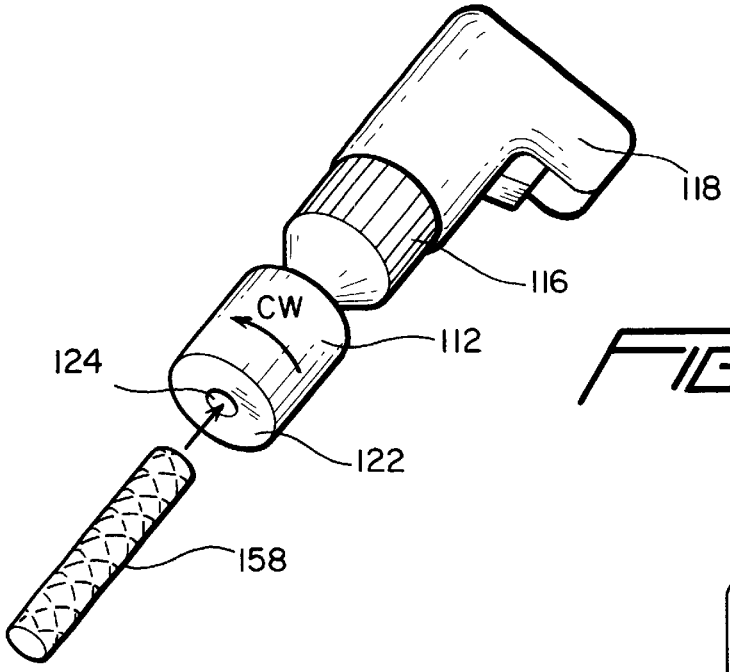
FIGS. 3–5 are schematic views showing the procedural steps comprising the use of the new and improved setting tool constructed in accordance with the principles and teachings of the present invention in order to drivingly insert both rebar and threaded rod anchor members into adhesive material disposed within pre-drilled holes or bores formed within an underlying substrate or foundation.

In accordance with the operation and use of the setting tool 110 of the present invention, additional reference is now to be made specifically to FIGS. 3–5. In order to fixedly secure a rebar or threaded rod anchor member within a particular substrate or foundation, a bore or hole 152 is pre-drilled within the substrate or foundation 154, and a suitable chemically activated adhesive material 156 is disposed within the pre-drilled bore or hole 152. The adhesive material 156 may comprise an adhesive material disposed in any one of several structural forms, such as, for example, the ampules or capsules as disclosed within the aforenoted Bonner and Sadanandan et al. patents, the adhesive material may also be contained within a rope, slug, or stick as disclosed within the aforenoted Surjan et al. patent. In connection with the instance illustrated within FIGS. 4 and 5, the adhesive material is shown as being embodied within a rope, slug, or stick similar to that disclosed within the aforenoted Surjan et al. patent. When a rebar or threaded rod anchor 158 is ready to be inserted and fixed within the pre-drilled bore or hole 152 now containing the adhesive material 156, the upper end portion 160 of the rebar or threaded rod anchor 158 is axially inserted into the open end of the large-diameter bore 124 formed within the collet housing 122 as illustrated within FIG. 3. In particular, the rebar or threaded rod anchor 158 is inserted into the large-diameter bore portion 124 and axially fed through such large-diameter bore portion 124 until the upper end portion 160 of the rebar or threaded rod anchor 158 encounters the upper end portion of the tapered diameter section 136 of the coil spring member 132, or the lower end portion of the stacked-coil small diameter section 138 of the coil spring member 132 such that frictional contact is effectively established between the upper end portion 160 of the rebar or threaded rod anchor 158 and the coil spring member 132.

Subsequently, the rotary drive of the rotary power tool 118 is activated so as to slowly rotate the chuck mechanism 116 thereof, and accordingly the collet housing 112 fixedly secured within the chuck mechanism 116, in the clockwise direction CW. In view of the fact that the upper end of the coil spring member 132, which comprises a right-handed spring, is effectively prevented from undergoing rotational movement with respect to the rebar or threaded rod anchor 158 as a result of the aforenoted frictional contact previously established between the upper end of the coil spring member 132 and the rebar or threaded rod anchor 158, and in view of the additional fact that the bent terminal end portion 144 of the coil spring member 132 is fixedly secured within the axial bore 146 by means of the set screw 150 disposed within radial bore 148, the slow clockwise CW rotation of the chuck mechanism 116 and the collet housing 112 causes the coil spring member 132 to effectively be circumferentially wrapped around the rebar or threaded rod anchor 158 in such a manner that the diametrical extent of the coil spring member 132 will radially contract whereby the coil spring member 132 now tightly grips the rebar or threaded rod anchor 158.

Accordingly, the gripped rebar or threaded rod anchor 158 is now ready to be inserted into the adhesive material 156 previously disposed within the bore 152 formed within the substrate or foundation, as disclosed within FIG. 4, and upon relatively slow rotational drive of the chuck mechanism 116 in the clockwise direction CW, in conjunction with the axial feeding of the rebar or threaded rod anchor 158 into the adhesive material 156, the adhesive material 156 is stirred, mixed, and activated. As may readily be appreciated, the degree to which the coil spring member 132 is radially contracted is variable depending upon the diametrical extent of the rebar or threaded rod anchor 158 being gripped, hence, the universal nature or utility of the setting tool 110 of the present invention. It is also noted, in conjunction with the use of threaded rods as the anchor members, that the radial contraction of the coil spring member 132 with respect to, or around the externally threaded shank portions of, such threaded rod anchors does not adversely affect the external threads formed upon the threaded rod anchors.

Ultimately, when the rebar or threaded rod anchor 158 has been fully inserted within the adhesive material 156, as disclosed within FIG. 5, the rotational drive of the power tool 118 is reversed, whereby the chuck mechanism 116 and the collet housing 112 are now driven in the counter-clockwise direction CCW, so as to effect the release of the coil spring member 132 from the rebar or threaded rod anchor 158 now disposed within the adhesive material 156. In particular, it is noted that as the chuck mechanism 116 and the collet housing 112 are driven in the counter-clockwise direction CCW, the circumferential forces previously imparted to the coil spring member 132, for causing the radial contraction thereof, are effectively relieved substantially immediately such that sufficient radial expansion of the coil spring member 132 occurs in order to enable the coil spring member 132 to be released from its gripped state upon or in connection with the rebar or threaded rod anchor 158. Accordingly, very little, if any, retrograde rotation of the rebar or threaded rod anchor 158 occurs at this time after the rebar or threaded rod anchor 158 has been fully inserted within the adhesive material 156 such that its disposition within the adhesive material 156 is substantially undisturbed. The power tool 118, the chuck mechanism 116, and the collet member 112 are then able to fully removed from the upper end portion of the rebar or threaded rod anchor 158 which now projects outwardly from the underlying foundation or substrate 154, and the adhesive material 156 is then permitted to cure and set so as to in fact fixedly secure the rebar or threaded rod anchor 158 therewithin.

Thus, it may be seen that in accordance with the principles and teachings of the present invention, there has been provided a single, new and improved setting tool which can be readily used in connection with the adhesive bonding of both rebar and threaded rod anchors within pre-drilled holes or bores formed within an underlying substrate or foundation. As a result of the unique and novel provision of the radially expansible and contractible coil spring member within the collet housing of the setting tool, the outer peripheral surface portions of both rebar and threaded rod anchor members are able to be tightly engaged for driving insertion into the adhesive material. In addition, the single setting tool can likewise be used to insert and fix rebar or threaded rod anchor members, having different diametrical extents or dimensions, within the pre-drilled, adhesive-filled holes or bores provided within the underlying foundations or substrates.

Obviously, many variations and modifications of the present invention are possible in light of the above teachings. It is therefore to be understood that within the scope of the appended claims, the present invention may be practiced otherwise than as specifically described herein.

In the claims:

1. A universal setting tool for use in connection with the insertion and fixation of different anchors within bores preformed within a substrate, comprising:

a collet housing defining an axis around which said collet housing is capable of being rotated;

a shaft integrally fixed upon a first end of said collet housing for insertion within a chuck mechanism of a rotary drive tool such that when said shaft is fixedly secured within the chuck mechanism of the rotary tool, and the chuck mechanism of the rotary tool is rotated, said collet housing will be rotated around said axis;

a first bore extending axially inwardly from a second end of said collet housing and defined by means of an inner peripheral wall wherein said first bore comprises an open space across its diametrical extent; and radially expansible and contractible means disposed within said open space of said first bore of said collet housing so as to be free to contract radially inwardly in a substantially unrestricted manner to variable extents within said open space of said first bore of said collet housing so as to render said setting tool capable of gripping different anchors having different diametrical extents when an anchor is inserted into said first bore of said collet housing and said collet housing is rotated in a first direction around said axis of said collet housing, and for expanding radially outwardly within said open space of said first bore of said collet housing when said collet housing is rotated in a second opposite direction around said axis of said collet housing so as to be capable of releasing an anchor previously inserted into said first bore of said collet housing and fixedly gripped by said radially expansible and contractible means as a result of said radially expansible and contractible means having been radially contracted in response to said collet housing having been rotated in said first direction around said axis of said collet housing.

2. The setting tool as set forth in claim 1, wherein:

said radially expansible and contractible means comprises a coil spring member.

3. The setting tool as set forth in claim 2, wherein said coil spring member comprises:

a small diameter portion disposed at an axially inner portion of said first bore of said collet housing for frictionally engaging an axially inner end portion of an anchor inserted into said first bore of said collet housing such that said small diameter portion of said coil spring member is effectively rotationally restrained as a result of the frictional engagement with the axially inner end portion of the anchor; and a large diameter portion disposed at an axially outer portion of said first bore of said collet housing for permitting the anchor to be axially inserted into said coil spring member such that the axially inner end portion of the anchor can engage said small diameter portion of said coil spring member.

4. The setting tool as set forth in claim 3, wherein:

said large diameter portion of said coil spring member comprises a terminal end portion which is fixedly secured to said collet housing so as to facilitate said radial contraction and expansion of said coil spring member as said collet housing is respectively rotated in said first and second directions around said axis.

5. The setting tool as set forth in claim 4, further comprising:

a second axially extending bore defined within said second end of said collet housing; and said terminal end portion of said coil spring member is disposed within said second axially extending bore defined within said second end of said collet housing.

6. The setting tool as set forth in claim 5, further comprising:

a radially extending bore defined within said second end of said collet housing and intersecting said second axially extending bore defined within said second end of said collet housing; and a set screw threadedly engaged within said radially extending bore for engaging said terminal end portion of said coil spring member so as to fixedly retain said terminal end portion of said coil spring member within said second axially extending bore.

7. The setting tool as set forth in claim 3, wherein:

said first axially extending bore defined within said collet housing comprises a stepped configuration, comprising a small diameter portion and a large diameter portion, for respectively accommodating said small and large diameter portions of said coil spring member.

8. The setting tool as set forth in claim 7, wherein:

said small diameter portion of said coil spring member comprises a plurality of axially compressed stacked coils; and said small diameter portion of said stepped bore defines a pocket region within which said plurality of axially compressed stacked coils are disposed.

9. The setting tool as set forth in claim 3, wherein said coil spring member further comprises:

a radially tapered section interconnecting said small and large diameter portions of said coil spring member.

10. In combination, a rotary tool, and a universal setting tool for use in connection with the insertion and fixation of different anchors within bores preformed within a substrate, comprising:

a rotary tool;

a chuck mechanism operatively mounted within said rotary tool; and a universal setting tool adapted to be removably mounted within said chuck mechanism of said rotary tool;

said universal setting tool comprising a collet housing defining an axis around which said collet housing is capable of being rotated; a shaft integrally fixed upon a first end of said collet housing for insertion within said chuck mechanism of said rotary drive tool such that when said shaft is fixedly secured within said chuck mechanism of said rotary tool, and said chuck mechanism of said rotary tool is rotated, said collet housing will be rotated around said axis; a first bore extending axially inwardly from a second end of said collet housing and defined by means of an inner peripheral wall such that said first bore comprises an open space across its diametrical extent; and radially expansible and contractible means disposed within said open space of said first bore of said collet housing so as to be free to contract radially inwardly in a substantially unrestricted manner to variable extents within said open space of said first bore of said collet housing so as to render said setting tool capable of gripping different anchors having different diametrical extents when an anchor is inserted into said first bore of said collet housing and said collet housing is rotated in a first direction around said axis of said collet housing, and for expanding radially outwardly within said open space of said first bore of said collet housing when said collet housing is rotated in a second opposite direction around said axis of said collet housing so as to be capable of releasing an anchor previously inserted into said first bore of said collet housing and fixedly gripped by said radially expansible and contractible means as a result of said radially expansible and contractible means having been radially contracted in response to said collet housing having been rotated in said first direction around said axis of said collet housing.

11. The combination as set forth in claim 10, wherein:

said radially expansible and contractible means comprises a coil spring member.

12. The combination as set forth in claim 11, wherein said coil spring member comprises:

a small diameter portion disposed at an axially inner portion of said first bore of said collet housing for frictionally engaging an axially inner end portion of an anchor inserted into said first bore of said collet housing such that said small diameter portion of said coil spring member is effectively rotationally restrained as a result of the frictional engagement with the axially inner end portion of the anchor; and a large diameter portion disposed at an axially outer portion of said first bore of said collet housing for permitting the anchor to be axially inserted into said coil spring member such that the axially inner end portion of the anchor can engage said small diameter portion of said coil spring member.

13. The combination as set forth in claim 12, wherein:

said large diameter portion of said coil spring member comprises a terminal end portion which is fixedly secured to said collet housing so as to facilitate said radial contraction and expansion of said coil spring member as said collet housing is respectively rotated in said first and second directions around said axis.

14. The combination as set forth in claim 13, further comprising:

a second axially extending bore defined within said second end of said collet housing; and said terminal end portion of said coil spring member is disposed within said second axially extending bore defined within said second end of said collet housing.

15. The combination as set forth in claim 14, further comprising:

a radially extending bore defined within said second end of said collet housing and intersecting said second axially extending bore defined within said second end of said collet housing; and a set screw threadedly engaged within said radially extending bore for engaging said terminal end portion of said coil spring member so as to fixedly retain said terminal end portion of said coil spring member within said second axially extending bore.

16. The combination as set forth in claim 12, wherein:

said first axially extending bore defined within said collet housing comprises a stepped configuration, comprising a small diameter portion and a large diameter portion, for respectively accommodating said small and large diameter portions of said coil spring member.

17. The combination as set forth in claim 16, wherein:

said small diameter portion of said coil spring member comprises a plurality of axially compressed stacked coils; and said small diameter portion of said stepped bore defines a pocket region within which said plurality of axially compressed stacked coils are disposed.

18. The combination as set forth in claim 12, wherein said coil spring member further comprises:

a radially tapered section interconnecting said small and large diameter portions of said coil spring member.

* * * * *